US010188935B2

(12) United States Patent
Kreuzinger et al.

(10) Patent No.: US 10,188,935 B2
(45) Date of Patent: Jan. 29, 2019

(54) SYSTEM FOR A TOURING SKI-BINDING COMPRISING A FRONT UNIT AND A HEEL UNIT

(71) Applicant: Markus Steinke, Ascholding (DE)

(72) Inventors: Michael Kreuzinger, Munich (DE); Markus Steinke, Ascholding (DE)

(73) Assignee: Markus Steinko, Ascholding (DE)

( * ) Notice: Subject to any disclaimer, the term of this patent is extended or adjusted under 35 U.S.C. 154(b) by 0 days.

(21) Appl. No.: 15/412,534

(22) Filed: Jan. 23, 2017

(65) Prior Publication Data

US 2017/0209770 A1 Jul. 27, 2017

(30) Foreign Application Priority Data

Jan. 23, 2016 (DE) ..... 10 2016 000 608

(51) Int. Cl.
*A63C 9/08* (2012.01)
*A63C 9/084* (2012.01)
(Continued)

(52) U.S. Cl.
CPC ..... *A63C 9/0807* (2013.01); *A63C 9/0841* (2013.01); *A63C 9/0842* (2013.01);
(Continued)

(58) Field of Classification Search
CPC ..... A63C 7/102; A63C 7/1046; A63C 9/0807; A63C 9/0841; A63C 9/0842; A63C 9/0844; A63C 9/086; A63C 2009/008
See application file for complete search history.

(56) References Cited

U.S. PATENT DOCUMENTS 4,002,354 A * 1/1977 Ramer ..... A63C 9/005 280/614
4,500,108 A * 2/1985 Johnson, III ..... A63C 9/0807 280/614
(Continued)

FOREIGN PATENT DOCUMENTS

DE 20 2013 009 713 U1 3/2014
DE 10 2013 204 064 A1 9/2014
(Continued)

OTHER PUBLICATIONS

European Search Report dated May 11, 2017 from corresponding European Patent Application No. 17152679.1; 5 pages.
(Continued)

*Primary Examiner* — Frank B Vanaman
(74) *Attorney, Agent, or Firm* — Ohlandt, Greeley, Ruggiero & Perle, L.L.P.

(57) ABSTRACT

System for a touring ski-binding comprising a front unit and heel unit comprising a heel member, wherein the stopper plate is switchable between an adjacent position and a protruding position, wherein the stopper plate is configures to leave the adjacent position when the touring ski binding is released, wherein the heel unit is switchable between a starting position for providing a blocking function and for receiving a ski boot, and a snap-in position for retaining the ski boot, wherein the heel unit comprises a walking means by means of which the stopper plate can be blocked in the adjacent position, wherein the blocking means with respect to the pivot axis is switchable between a blocking position and a non-blocking position depending on the position of the heel member, wherein with respect to the downhill mode the front unit in the climbing mode of the touring ski-binding is displaced to the front in the longitudinal direction of the ski,
(Continued)

so that a ski boot present in the touring ski-binding cannot contact the heel member of the heel unit.

9 Claims, 11 Drawing Sheets

(51) Int. Cl.

| | |
|---|---|
| ***A63C 9/085*** | (2012.01) |
| *A63C 7/10* | (2006.01) |
| *A63C 9/086* | (2012.01) |
| *A63C 9/00* | (2012.01) |

(52) U.S. Cl.
CPC ..... *A63C 9/0844* (2013.01); *A63C 9/08521* (2013.01); *A63C 7/102* (2013.01); *A63C 7/1046* (2013.01); *A63C 9/086* (2013.01); *A63C 2009/008* (2013.01)

(56) References Cited

U.S. PATENT DOCUMENTS

| | | | | |
|---|---|---|---|---|
| 9,138,630 | B2 * | 9/2015 | Brandl | A63C 9/001 |
| 9,526,972 | B2 | 12/2016 | Steinke | |
| 2011/0049821 | A1 * | 3/2011 | Trabucchi | A43B 5/0417 280/11.33 |
| 2011/0203138 | A1 * | 8/2011 | Shute | A63C 7/1013 36/92 |
| 2012/0025489 | A1 * | 2/2012 | Meindl | A63C 9/006 280/607 |
| 2013/0056960 | A1 * | 3/2013 | Chickering-Ayers | A63C 9/003 280/614 |
| 2013/0181427 | A1 * | 7/2013 | Fritschi | A63C 9/007 280/614 |
| 2014/0070519 | A1 * | 3/2014 | Fritschi | A63C 9/006 280/623 |

FOREIGN PATENT DOCUMENTS

| | | | |
|---|---|---|---|
| DE | 10 2013 204 065 | A1 | 9/2014 |
| DE | 20 2011 110 813 | U1 | 7/2016 |
| EP | 1 961 463 | A1 | 8/2008 |
| EP | 2 281 614 | A1 | 2/2011 |
| EP | 2695647 | A1 | 2/2014 |
| EP | 2 705 883 | A1 | 3/2014 |
| EP | 2813268 | A1 | 12/2014 |
| EP | 2987538 | A1 | 2/2016 |
| WO | 2009/105866 | A1 | 9/2009 |
| WO | 2009/153615 | A1 | 12/2009 |

OTHER PUBLICATIONS

German Examination Report dated Nov. 7, 2016 from corresponding German Application No. 10 2016 000 608.0, 6 pages.

* cited by examiner

A–A

SYSTEM FOR A TOURING SKI-BINDING COMPRISING A FRONT UNIT AND A HEEL UNIT

CROSS-REFERENCE TO RELATED APPLICATIONS

The present application claims priority to German Patent Application No. 10 2016 000 608.0, filed on Jan. 23, 2016, the entirety of which is herein incorporated by reference.

TECHNICAL FIELD

The present invention relates to a system for a touring ski-binding comprising a front unit and a heel unit comprising a heel member, wherein the heel member comprises a reception bowl for receiving the heel part of a ski boot and a biasing device for biasing the heel unit against a ski boot, and wherein the heel member is disposed pivotable around a pivot axis, wherein the pivot axis runs horizontally, transverse to the longitudinal direction of the ski, and a stopper plate for releasing a ski stopper, wherein the stopper plate is switchable between an adjacent position and a protruding position.

BACKGROUND ART

In the first place ski-bindings for touring skis are characterized by being switchable between a climbing mode and a downhill mode compared to ordinary ski-bindings. In the climbing mode only the front part of the ski boot is fixed to the ski so that the heel part of the ski boot can be lifted from the ski and set down on the ski. The front part of the ski boot can rotate about a horizontal axis which is perpendicular to the longitudinal direction of the ski. In the downhill mode both the front part as well as the heel part of the ski boot are fixed to the ski.

Conventional touring ski-binding systems can be divided into bridge binding systems and pin binding systems. In terms of pin systems the bindings can be subdivided into a front unit and a heel unit. In the climbing mode the ski boot is pivot-mounted only by the front unit around a horizontal pivot axis extending perpendicular to the longitudinal direction of the ski.

In general, touring binding systems have a ski stopper by means of which the ski can be stopped when the ski loosens itself from the ski while the binding is in the downhill mode. In the climbing mode the stopper function has to be suppressed so that the ski boot can be lifted without the stopper being released. From the background art different solutions for blocking the ski stopper while the binding is in the climbing mode are known. DE 20 2013 009 713 U1, for example, shows a braking device for a touring ski with an integrated adjustable climbing wedge. WO2009/105866 A1 shows a heel unit for an alpine touring ski-binding. DE 10 2013 204 065 A1 relates to a heel unit with a ski brake for a touring ski binding.

The pin systems known from the prior art have the disadvantage that the heel units have to be operated manually in order to block the stopper. Furthermore, the known solutions for the provision of the blocking function of the ski stopper require complex constructive solutions as, for example, an operating lever mechanism or the replacement of the entire heel unit in the longitudinal direction of the ski. This results in a cumbersome handling of the known touring binding systems when switching between the downhill mode and the climbing mode.

DISCLOSURE OF THE INVENTION

Starting from the known prior art it is an aspect of the present invention to provide an improved heel unit. This aspect is solved by means of a system with the features of claim 1. Advantageous embodiments can be taken from the dependent claims.

Accordingly, a system for a touring ski-binding comprising a front unit and a heel unit is given, comprising a heel member, wherein the heel member comprises a reception bowl for receiving the heel part of a ski boot, a biasing device for biasing the heel unit against the ski boot, wherein the heel member is pivotally disposed around a pivot axis, wherein the pivot axis runs horizontally, transverse to the longitudinal direction of the ski, and a stopper plate for releasing a ski stopper, wherein the stopper plate is switchable between an adjacent position and a protruding position, wherein the stopper plate is configured to leave the adjacent position when the touring ski binding is released, wherein the heel unit is switchable between a starting position for providing a walking function and for receiving a ski boot, and a snap-in position for retaining the ski boot. The heel unit comprises a blocking means by means of which the stopper plate can be blocked in the adjacent position, wherein the blocking means with respect to the pivot axis is switchable between a blocking position and a non-blocking position depending on the position of the heel member. Furthermore, with respect to the downhill mode the front unit in the climbing mode of the touring ski-binding is displaced to the front in the longitudinal direction of the ski, so that a ski boot present in the touring ski-binding cannot contact the heel member of the heel unit.

Thereby, no active adjustment of the blocking means by the user is necessary. In fact, the position of the blocking means only depends on the position of the heel member. If, for example, the heel member is in the starting position, the blocking means is in the blocking position in which it is ready to block the stopper plate. If the stopper plate is brought from the protruding position into the adjacent position, for example by means of the sole of a ski boot, the stopper plate can snap-in on the blocking means so that it is held in the adjacent position by the latter.

If the heel unit is in the snap-in position the blocking means is retained in the non-blocking position so that the stopper plate can move to the protruding position if there is no counter acting force.

Accordingly, an automatic switching between the blocking position and the non-blocking position of the blocking means is provided which complies with the mode of the touring ski-binding. In the climbing mode the heel member is in the starting position. To the contrary, in the downhill mode the heel member is in the snap-in position.

Furthermore, it is possible that although the stopper plate is contacted when lowering the heel part of a ski boot, the heel member is not contacted. Accordingly, the stopper plate can be brought into the adjacent position in which it is blocked by the blocking means. Thereby, the heel unit maintains its starting position. Because the heel part of the ski boot does not reach or contact the reception bowl of the heel member, a lowering of the heel part of the ski boot does not lead to a switch to the downhill mode of the touring ski-binding.

The ski stopper functions according to the principle of a common ski stopper. The stopper plate is pivotally mounted around a horizontal axis perpendicular to the longitudinal direction of the ski on two connecting arms running parallel towards each other. The connecting arms themselves can be mounted on a ski surface or on the surface of a base plate and be pivotally around a horizontal pivot axis transverse to the longitudinal direction of the ski. Two opposing stopper arms running parallel towards each other extend from the connecting arms, wherein the stopper arms also carry out the pivot movement of the connecting arms around the horizontal axis transverse to the longitudinal direction of the ski. Thereby, the stopper arms are oriented in a manner, so that when the connecting arms protrude from a ski surface, wherein the stopper plate is in the protruding position, the stopper arms point away from the bottom side of the ski, so that they can protrude into a riding surface of the ski, i.e., if the stopper plate is in the protruding position, the stopper arms protrude over a ski bottom side in order to slow-down the ski.

If a force acts on the stopper plate, whereby the stopper plate is moved towards a ski surface or the surface of a base plate, the stopper arms pivot around the horizontal axis transverse to the longitudinal direction of the ski and take-up a position in which they run almost parallel to the longitudinal direction of the ski. That means that in the adjacent position of the stopper plate, in which the stopper plate lies flat on a ski surface or a surface of a base plate, the stopper arms run almost parallel to the longitudinal direction of the ski, so that they do not provide a stopping function.

Starting position of the heel unit means the position in which the heel unit and in particular the heel member are ready to receive the heel part of a ski boot. Furthermore, the starting position of the heel unit can also be provided, even if in the climbing mode the ski boot shall not contact the heel member. In this case the heel part of the ski boot can be lowered onto the stopper plate but not onto the heel member.

Snap-in position means the position of the heel unit in which the heel part of a ski boot is snapped-in in the heel unit and is biased by means of the heel member against a ski surface or the surface of a base plate.

Blocking position means the position in which the blocking means can retain the stopper plate in the adjacent position. If the blocking means is already in the blocking position and the stopper plate is still in the protruding position, the stopper plate can couple with the blocking means by transferring into the adjacent position, whereby the blocking means block the stopper plate in the adjacent position.

Non-blocking position means the position in which the stopper plate is released from the blocking means or in the case in which the stopper plate is in the adjacent position is not blocked in that position by the blocking means.

In a further embodiment the blocking means is disposed in a relative displaceable manner with respect to the heel member. Accordingly, it is possible to displace the blocking means between the blocking position and the non-blocking position depending on the position of the heel member.

In a further embodiment the heel member comprises a first pressure area which can be brought into contact with the blocking means, wherein a movement of the first pressure area towards the blocking means pushes the blocking means from the non-blocking position to the blocking position.

Thus, by applying a force to the heel member it is possible to push the blocking means into the blocking position. Thereby, the first pressure area is defined by the contact area between the heel member and the blocking means, which arises when the heel member pivots around the pivot axis, which is horizontal, transverse to the longitudinal direction of the ski, and pushes the blocking means into the direction of the blocking position.

In a further embodiment the first pressure area is in contact with the blocking means when the heel unit is in the starting position. Accordingly, the blocking means can be brought into the blocking position by moving the heel unit to the starting position.

In a further embodiment the heel member comprises a second pressure area which can be brought into contact with the blocking means, wherein a movement of the second pressure area towards the blocking means can push the blocking means from the blocking position to the non-blocking position.

Thus, by means of a pivot movement of the heel member around the pivot axis, which runs horizontally, transverse to the longitudinal direction of the ski, it is possible to release the stopper plate. The second pressure area only contacts the blocking means if a rotation around the pivot axis, which runs horizontally, transverse to the longitudinal direction of the ski, takes place in the opposite direction with respect to the contact of the first pressure surface.

The second pressure surface of the heel member 10 may be in contact with the blocking means when the heel unit is in the snap-in position. In this position the heel part of a ski boot is retained in the heel unit. The stopper plate is retained in the adjacent position by the presence of the ski boot. If, for example, in the case of a fall, the heel unit releases the ski boot, the stopper plate can take-up the protruding position as the blocking means is in the non-blocking position.

In a further embodiment the second pressure area is the bottom side of a flange, wherein a top side of a flange serves for receiving the heel part of a ski boot. Conventional heel members usually have a flange at the lower edge of the reception bowl, by means of which the heel unit starts to take-in the snap-in position when a ski boot steps into the binding. The bottom side of the flange is suitable to contact the blocking means and to move it into the non-blocking position when the heel member undergoes a rotation around the pivot axis, which is disposed horizontally, transverse to the longitudinal direction of the ski.

In a further embodiment the blocking means is disposed on a base plate, wherein the base plate can be disposed on a surface of the ski. Generally, conventional heel units have a base plate. Accordingly, it is sufficient to dispose the blocking means on a conventional base plate or to integrate it into a conventional base plate. The base plate forms the interface of the heel unit to the surface of the ski.

In a further embodiment the base plate and the blocking means are displaceably coupled relative to each other by means of a groove guiding. The groove defines the displacement path of the blocking means with respect to the base plate. The groove can be disposed in the blocking means or in the base plate. If the groove is disposed in the blocking means, the base plate has a complementary guiding, for example a rail, which engages with the groove. If the groove is disposed in the base plate, the blocking means has the guiding. The length of the groove guiding allows the displacement of the blocking means between the blocking position and the non-blocking position. Furthermore, the groove guiding enables an exact positioning or displacing of the blocking means on the base plate.

A groove of the groove guiding which for example runs on the surface of the blocking means, can have slanting walls, so that when seen from the surface of the blocking means an undercut is provided. By means of a guiding on the surface of the base plate, which is complementary to the groove, the base plate can be securely retained in the groove.

The groove can be configured in a way, that it runs through the entire blocking means, i.e. so that the ends of the groove are open. Thus, it is possible that by means of the guiding residues, such as snow, located in the groove can be pushed-out of the groove.

In a further embodiment the blocking means comprises at least one retaining member for retaining the stopper plate in the blocking position. For example, the retaining member can be pin-like. The stopper plate may comprise a clamp device by means of which the stopper plate can be clamped to the retaining member. Thereby it is possible to block the stopper plate even if the blocking means is already in the blocking position.

In a further embodiment the heel unit comprises snap-in means in order to retain the blocking means in the blocking position and/or the non-blocking position. Thereby, it is prevented that the blocking means automatically loosens from the blocking position or the non-blocking position during the use of the heel unit. For example, the snap-in means can be provided by means of a biased bracket on the guiding of the blocking means, which interacts with a shaping in a groove of a base plate in which the blocking means is guided. At the height of the shaping the groove has a greater width, whereby the biased bracket of the blocking means can expand. In order to transfer the guiding of the blocking means from the broader area of the groove, i.e. the area of the shaping, to is the narrower area of the groove a manual intervention of the user is required.

BRIEF DESCRIPTION OF THE DRAWINGS

Further embodiments and aspects of the present invention are described by means of the following description and figures in more detail.

DETAILED DESCRIPTION OF THE EMBODIMENTS

Hereafter different embodiments are described according to the figures. The same elements, similar elements or elements with the same effect are identified with the same reference signs. In order to avoid redundancies there is partially no repeated description of these elements in the following description.

Figure 1A:
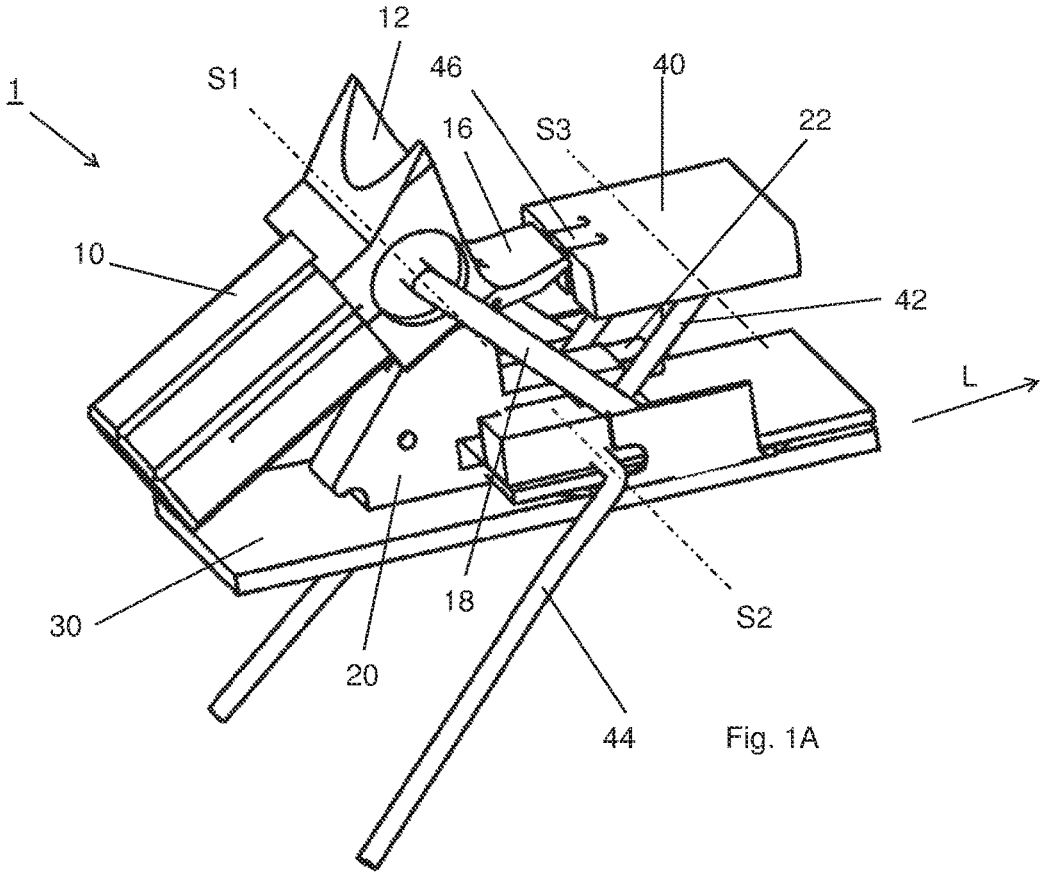
FIG. 1A schematically shows a perspective view of a heel unit wherein a stopper plate is in a protruding position, FIG. 1B schematically shows a side-view of the heel unit of FIG. 1A, FIG. 2A schematically shows a perspective view of the heel unit of FIG. 1A wherein the stopper plate is in an adjacent position, FIG. 2B schematically shows a side-view of the heel unit of FIG. 2A, FIG. 3A schematically shows a perspective view of the heel unit of FIG. 1A wherein the heel unit is in a snap-in position, FIG. 3B schematically shows a side-view of the heel unit of FIG. 3A, FIG. 4A schematically shows a perspective view of the heel unit of FIG. 1A wherein the stopper plate is about to leave the adjacent position, FIG. 4B schematically shows a side-view of the heel unit of FIG. 4A, FIG. 5A schematically shows a detailed view of a blocking means wherein the stopper plate is in the adjacent position, FIG. 5B schematically shows a sectional view of the cutting line A-A of FIG. 5A wherein the inner action of a blocking means and the stopper plate is shown, FIG. 6A schematically shows a front unit and a heel unit of a touring ski-binding which is in a climbing mode, FIG. 6B schematically shows a front unit and a heel unit of a touring ski-binding which is in the downhill mode.
Figure 1B:
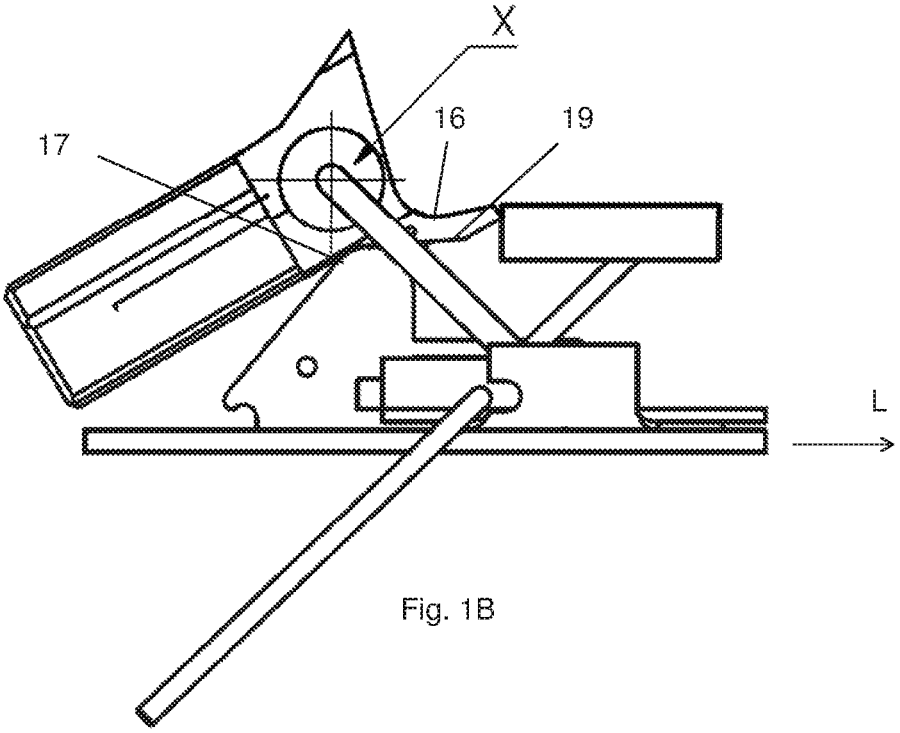

FIGS. 1A and 1B show a heel unit 1 in the starting position. The heel unit 1 comprises a heel member 10, which comprises a reception bowl 12 and a flange 16. The reception bowl 12 is configured to receive the heel part of a ski boot. The heel member 10 is connected to the base plate 30 by means of two brackets 18 running parallel with respect to each other. The heel member 10 is not displaceable in a longitudinal direction of the ski L, however, it can be rotated around a pivot axis S1 which runs horizontally, transverse to the longitudinal direction L of the ski.

Furthermore, the heel unit 1 comprises a stopper plate 40, which is mounted on the base plate 30 by means of two connecting arms 42 running parallel with respect to each other. The connecting arms 42 are disposed in a pivotable manner around a pivot axis S2, which runs horizontally, transverse to the longitudinal direction of the ski L. Two stopper arms 44 running parallel with respect to each other extend from the pivot axis S2, wherein the stopper arms 44 are integrally formed with the connecting arms 42, respectively. The connecting arms 42 and the stopper arms 44 are disposed in one plane, which can rotate around the pivot axis S2.

The stopper plate 40 is mounted at the ends of the connecting arms 42 in a pivotable manner and can be rotated around a pivot axis S3, which runs horizontally, transverse to the longitudinal direction of the ski L.

In FIGS. 1A and 1B the stopper plate 40 is in a protruding position, in which it is spaced apart from the space plate 30. Thereby, the plane in which the connecting arms 42 and the stopper arms 44 are disposed, crosses the longitudinal direction of the ski L in a way that the stopper arms 44 extend downward from the base plate. In this position the stopper arms 44 can contact a ground on which the ski moves and, thus, slow-down the ski.

The heel unit 1 further comprises a blocking means 20, which is disposed between the heel member 10 and the base plate 30. The blocking means 20 has retaining members 22, which interact with a clamping device 46 of the stopper plate 40. FIG. 1B shows that the heel member 10 has a first pressure area 17 by means of which the heel member 10 may push the blocking means 20 in the longitudinal direction of the ski L towards a ski tip. In FIGS. 1A and 1B the starting position of the heel unit is shown, in which the blocking means 20 have been pushed by the first pressure area 17 into a blocking position. In this blocking position, the blocking means 20 and in particular its retaining members 22 are ready to immerse into the clamping device 46 of the stopper plate 40 in order to retain the stopper plate 40 in an adjacent position in which the stopper plate 40 is adjacent to the base plate 30.

Accordingly, an automatic switching of the blocking means 20 is provided, which depends on the position of the heel member 10. Thus, no manual intervention of the user is required to switch the blocking means 20.

FIG. 1B further shows a second pressure area 19 on the bottom side of the flange 16, by means of which the blocking means can be displaced against the longitudinal direction of the ski L.

Figure 2A:
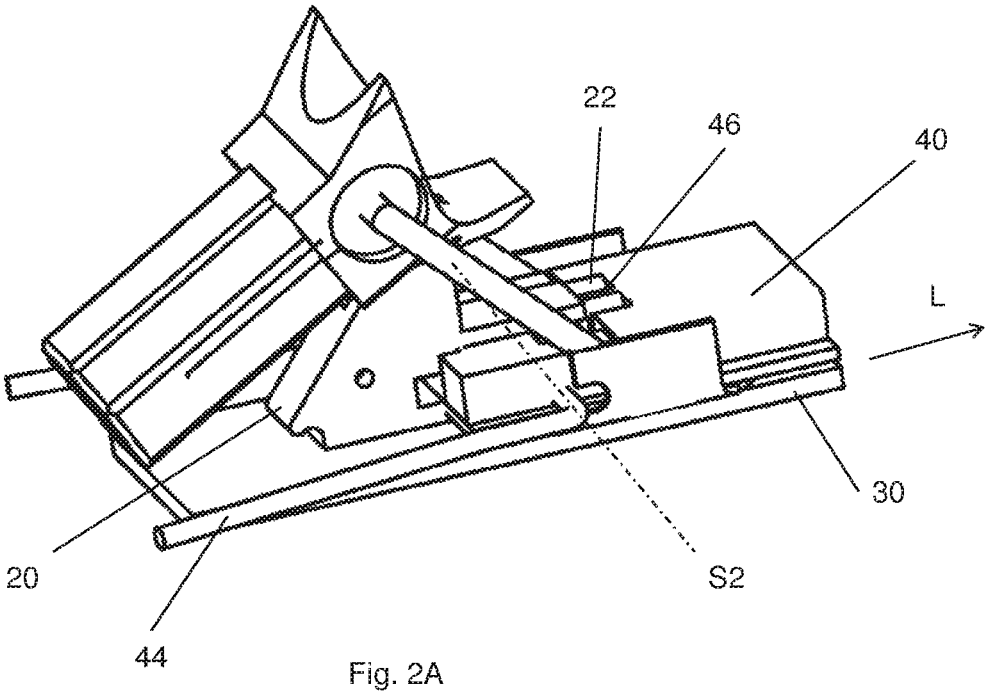
Figure 2B:
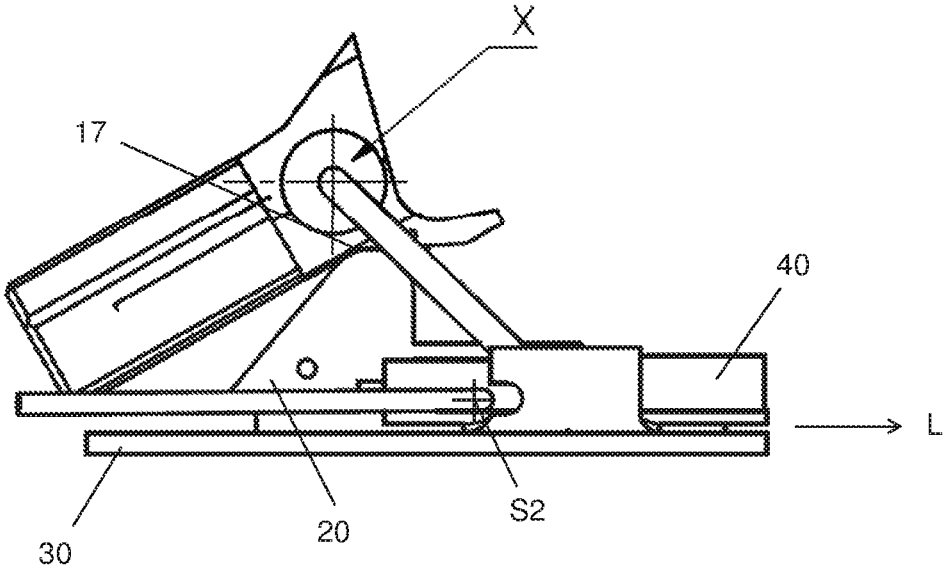

FIGS. 2A and 2B also show the heel unit 1 in the starting position. In contrast to FIGS. 1A and 1B the stopper plate 40 is in the adjacent position, in which it is adjacent to the base plate 30. The blocking means 20 is in the blocking position, wherein the retaining members 22 of the blocking means 20 are coupled with the clamping device 46 of the stopper plate 40 and, thus, block the stopper plate 40 in the adjacent position. For example, the stopper plate 40 can be brought into the adjacent position shown in FIGS. 2A and 2B by means of the sole of ski boot.

FIG. 2B further shows that the first pressure area 17 of the heel member 10 contacts the blocking means 20, wherein the blocking means 20 is in the blocking position.

FIGS. 2A and 2B further show that because the stopper plate 40 is in the adjacent position, the stopper arms 44 executed a rotation around the pivot axis S2 with respect to the FIGS. 1A and 1B, so that the stopper arms 44 almost run parallel to the longitudinal direction of the ski L. In this position the stopper arms 44 have no braking effect. The position of the heel unit 1 shown in FIGS. 2A and 2B can for example be desired when a touring ski-binding is in the downhill mode. The sole of the ski boot can be lifted from the stopper plate 40, wherein the blocking means 20 prevents the stopper plate 40 from taking the protruding position and creating a braking effect. The endeavor of the stopper plate 40 to take-up the protruding position can be provided by means of a torsion spring, which is capable to rotate the connecting arms 42 and the stopper arms 44 around the pivot axis S2.

Figure 3A:
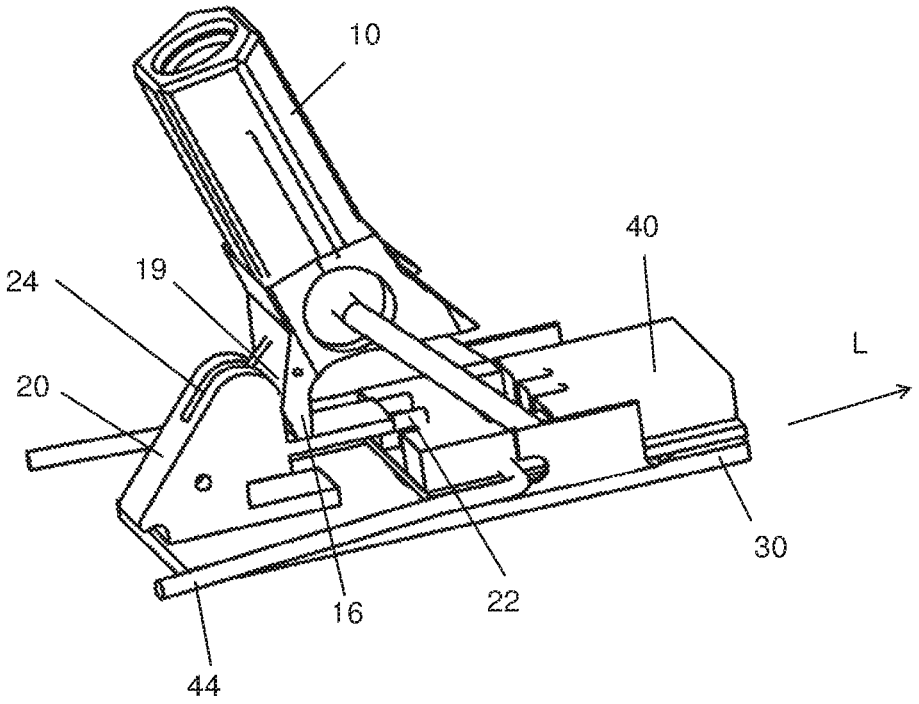
Figure 3B:
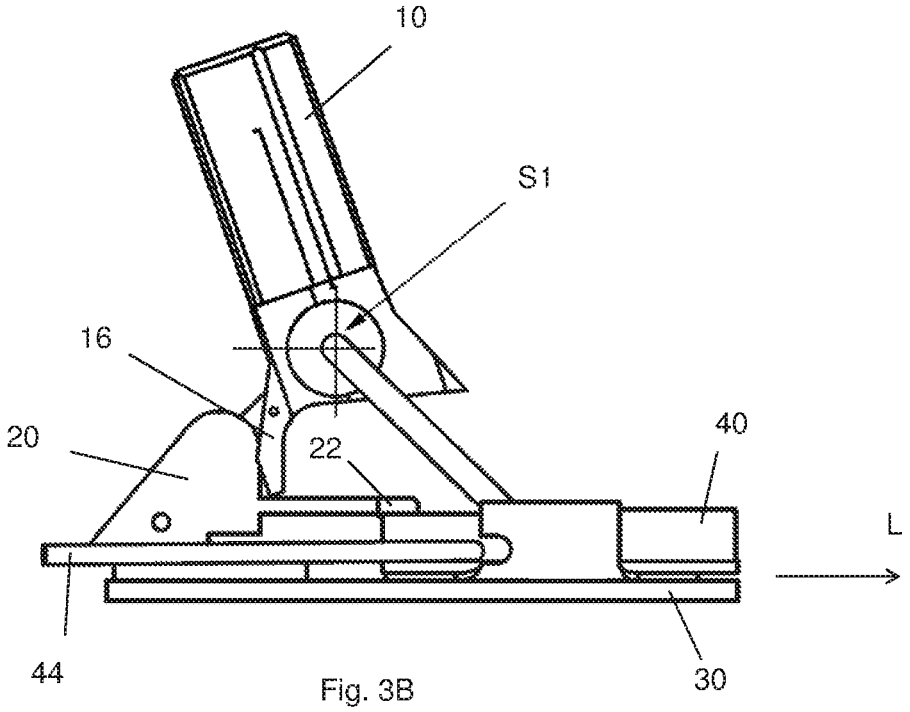

FIGS. 3A and 3B show the heel unit 1 in the snap-in position. The heel unit 1 takes-up this position when the heel part of a ski boot is biased against the base plate 30. I.e., the touring ski-binding is in the downhill mode, wherein a ski boot is fixedly clamped in the touring ski-binding. FIGS. 3A and 3B show the blocking means 20 in a non-blocking position, into which it has been pushed by the second pressure area 19 of the heal member 10. The blocking means 20 has a guiding 24 by means of which the second pressure area 19 can be guided on the blocking means.

The stopper plate 40 is held in the adjacent position by the sole of a ski boot clamped in the touring ski-binding. If, for example, in the invent of a fall, the binding releases the ski boot and the stopper plate 40 can take-up the protruding position as it is not blocked by the blocking means 20. Thereby, the stopper arms 44 are moved into the direction of the riding surface, so that the lost ski can be slowed down.

As can be taken from FIGS. 3A and 3B the blocking means 20 is brought into the non-blocking position in that the heel member 10 takes-up the snap-in position. This results in an automatic switching of the blocking means 20, which depends on the position of the heel member 10. Thus, no manual intervention of the user is required to switch the blocking means 20.

Figure 4A:
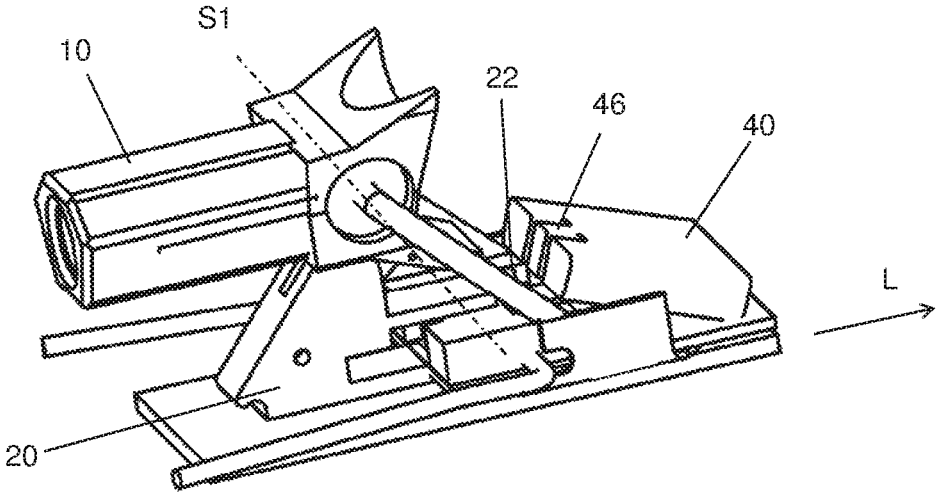
Figure 4B:
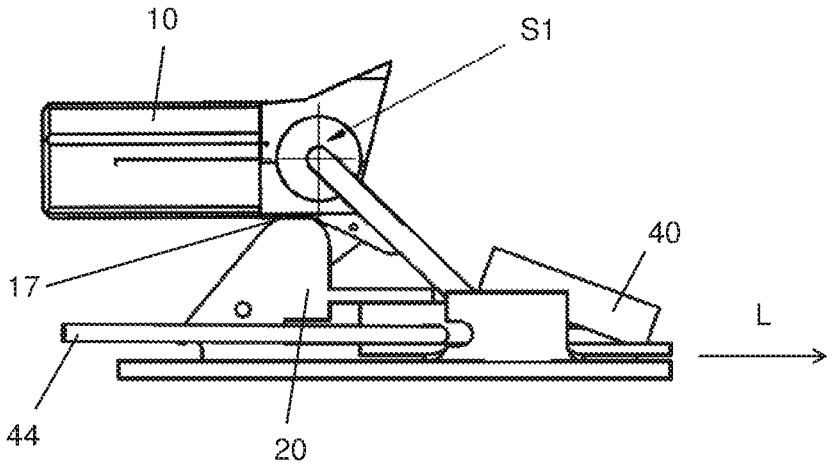

FIGS. 4A and 4B show the heel unit 1 in a state in which the touring ski-binding releases, i.e. in a state, in which the touring ski-binding releases a ski boot that previously has been clamped. The stopper plate 40 already partially has left the adjacent position, as it is configured to leave the adjacent position when the touring ski binding is released. With respect to the snap-in position shown in FIGS. 3A and 3B, the heel member 10 has been pivoted around the pivot axis S1, so that now the first pressure area 17 is in contact with the blocking means. With respect to the snap-in is position shown in FIGS. 3A and 3B the blocking means 20 has been moved in the longitudinal direction of the ski L by the first pressure area 17. The retaining members 22, however, are not engaged with the clamping device 46. Furthermore, the stopper arms 44 still run almost parallel to the longitudinal direction of the ski L.

In the position of the heel unit 1 shown in FIGS. 4A and 4B a ski boot clamped in the touring ski-binding can loosen, wherein the stopper plate 40 can move into the protruding position so that the breaking function of the ski stopper is activated.

Figure 5A:
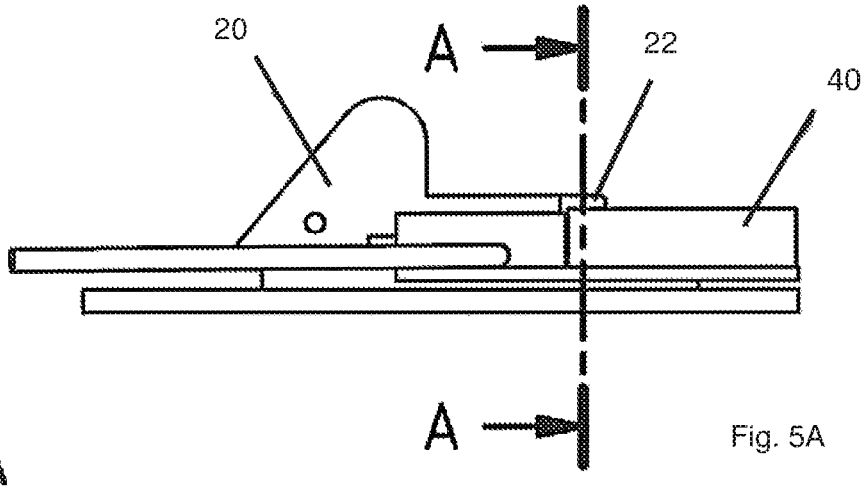

FIG. 5A shows a detailed view of the blocking means 20 and the stopper plate 40. The blocking means 20 is in the blocking position while the stopper plate 40 is in the adjacent position. Accordingly, the stopper plate 40 is blocked by the retaining members 22.

Figure 5B:
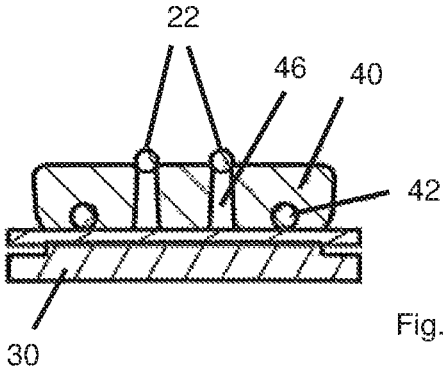

FIG. 5B is a cross-sectional view along the cutting line A-A of FIG. 5A. The retaining members 22 block the stopper plate 40 and hold the latter in the adjacent position. FIG. 5B shows the clamping device 46 by mans of which the stopper plate 40 can be clamped in the adjacent position when the blocking means 20 is already in the blocking position. The clamping device 46 has tapered recesses in the stopper plate 40, through which the retaining members 22 can slide. The walls of the clamping device 46 are flexible so that the retaining members 22 entirely can glide there through. The upper gap of the clamping device has a smaller width than the width of the retaining members 22, so that a retaining member 22 cannot slide back after it has passed the flexible walls of the clamping device 46. The walls are made of flexible plastic. Alternatively, the walls can be made of flexible sheet metal.

Figure 6A:
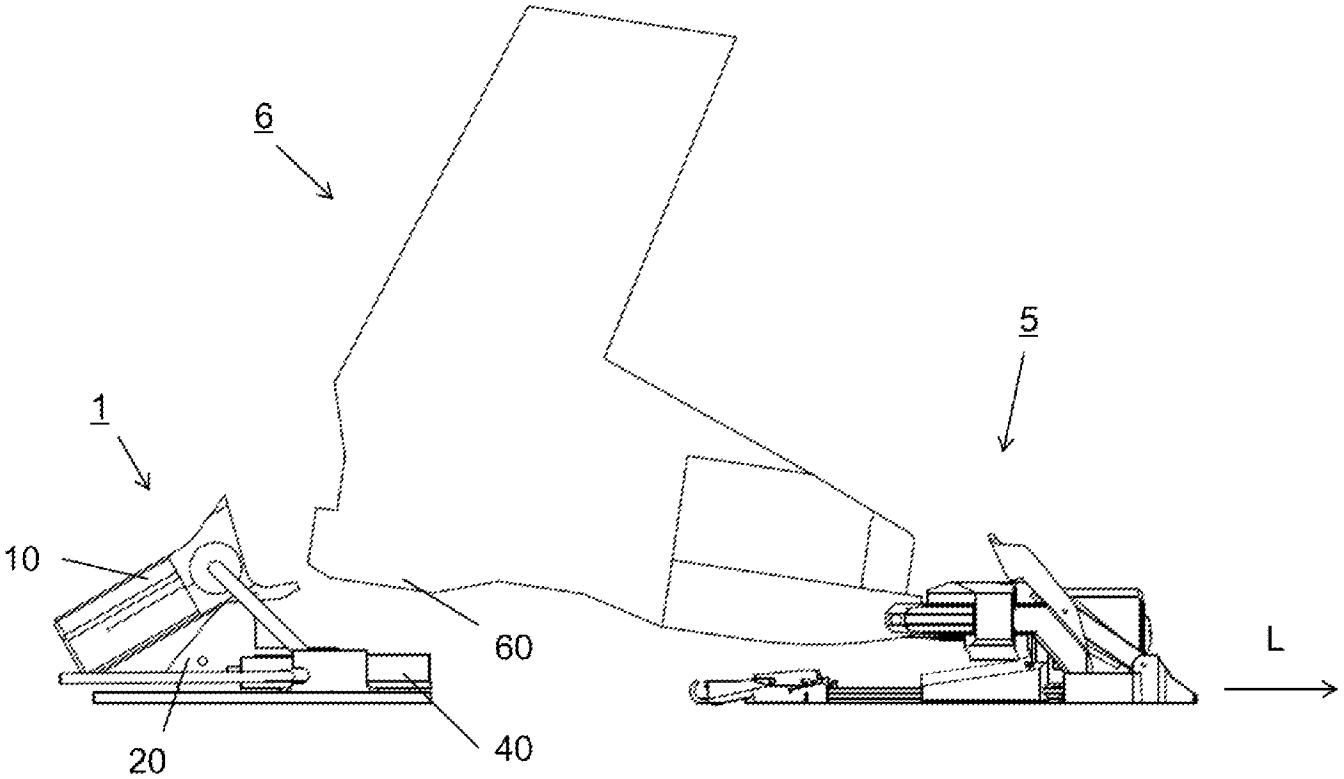

FIG. 6A shows a touring ski-binding system in the climbing mode. The touring ski-binding system comprises a heel unit 1 and a front unit 5. A ski boot 6 is pivotally mounted on the front unit 5 around a horizontal axis, which runs transverse to the longitudinal direction of the ski L. The heel part 60 of the ski boot 6 can be lowered onto the heel unit 1 and lifted there from. The heel member 10 holds the blocking means 20 in the blocking position, whereby the stopper plate 40 is retained in the adjacent position even if the heel part 60 is lifted. Due to the mounting position of the ski boot 6 on the front unit 5 the ski boot does not get into contact with the heel member 10. An appropriate front unit can be taken, for example, from US 2016/0074742 A1 which is hereby incorporated by reference.

Figure 6B:
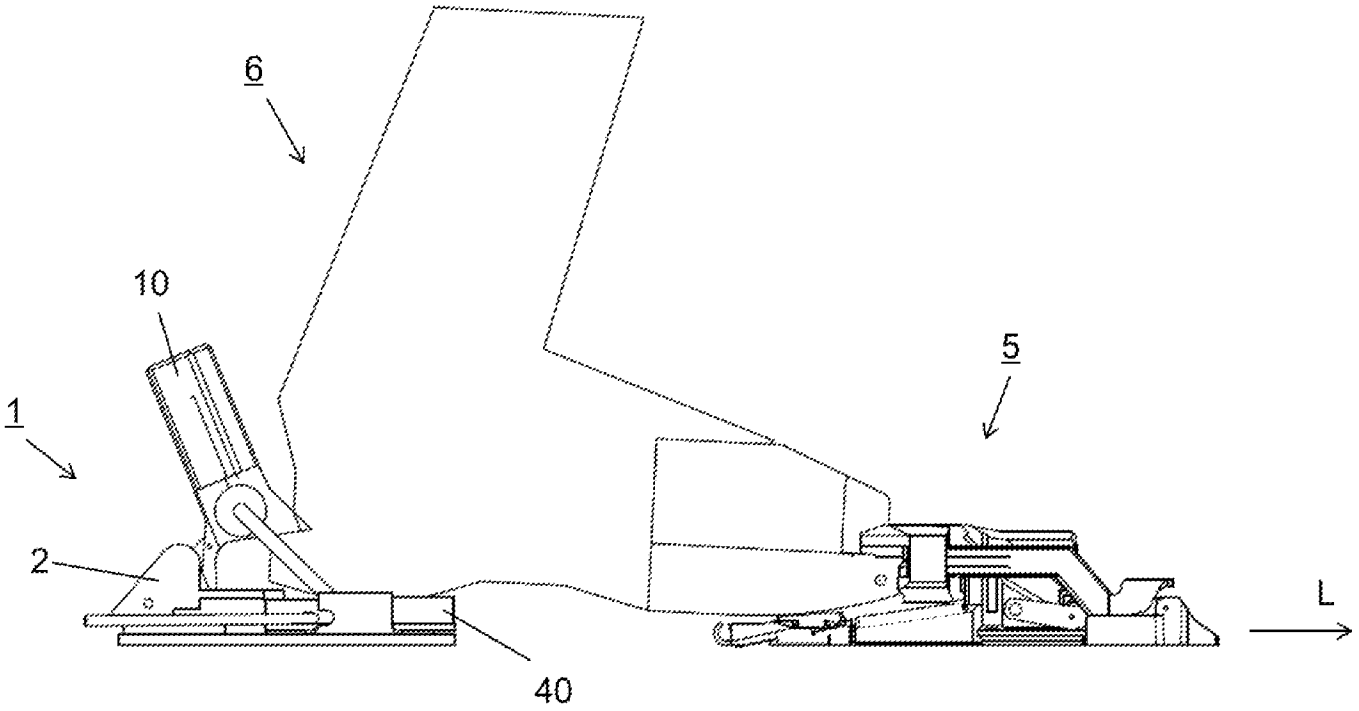

FIG. 6B shows the touring ski-binding system of FIG. 6A in the downhill mode. The ski boot 6 is fixedly clamped between the front unit 5 and the heel unit 1. The heel member 10 holds the blocking means 20 in the non-blocking position. The stopper plate 40 is retained in the adjacent position by the heel part 60 of the ski boot 6.

The single components of the touring ski-binding system are made of plastic and/or metal. In case of the rubber parts also injection molding parts can be used. In general, light materials are used, in particular, fiber reinforced plastics and/or aluminum.

As far as applicable, single features shown in the embodiments can be combined and/or replaced with each other without departing the field of the invention.

LIST OF REFERENCE NUMERALS

1 heel unit
10 heel member
12 reception bowl
14 biasing device
16 flange
17 first pressure area
18 bracket

19 second pressure area
20 blocking means
22 retaining member
24 guiding
30 base plate
40 stopper plate
42 connecting arm
44 stopper arm
46 clamping device
5 front unit
6 ski boot
60 heel part
L longitudinal direction of the ski
S1 pivot axis
S2 pivot axis
S3 pivot axis

The invention claimed is:

1. A system for a touring ski-binding comprising a front unit and a heel unit comprising a heel member, wherein the heel member comprises a reception bowl for receiving a heel part of a ski boot, a biasing device for biasing the heel unit against a ski boot, wherein the heel member is pivotally disposed around a pivot axis, wherein the pivot axis runs horizontally, transverse to a longitudinal direction of a ski, and a stopper plate for releasing a ski stopper, wherein the stopper plate is switchable between an adjacent position and a protruding position, wherein the stopper plate is configured to leave the adjacent position when the touring ski binding is released, wherein the heel unit is switchable between a starting position for providing a walking function and for receiving a ski boot, and a snap-in position for retaining the ski boot, wherein the heel unit comprises a blocking element configured to block the stopper plate in the adjacent position, wherein the blocking element is configured to switch, with respect to the pivot axis, between a blocking position and a non-blocking position depending on the position of the heel member, wherein with respect to a downhill mode the front unit in a climbing mode of the touring ski-binding is displaced to the front in the longitudinal direction of the ski, so that a ski boot present in the touring ski-binding cannot contact the heel member of the heel unit.

2. The system according to claim 1, wherein the blocking element is disposed in a relative displaceable manner with respect to the heel member.

3. The system according to claim 1, wherein the heel member comprises a first pressure area which can be brought into contact with the blocking element, wherein the system is configured such that a movement of the first pressure area towards the blocking element is configured to push the blocking element from the non-blocking position to the blocking position.

4. The system according to claim 3, wherein the first pressure area is in contact with the blocking element when the heel unit is in the starting position.

5. The system according to claim 3, wherein the heel member comprises a second pressure area configured to be brought into contact with the blocking element, wherein the system is configured such that a movement of the second pressure area towards the blocking element is configured to push the blocking element from the blocking position to the non-blocking position.

6. The system according to claim 5, wherein the second pressure area is the bottom side of a flange, wherein a top side of the flange is configured to receive the heel part of a ski boot.

7. The system according to claim 1, wherein the blocking element is disposed on a base plate, wherein the base plate is configured to be disposed on a surface of the ski.

8. The system according to claim 7, wherein the base plate and the blocking element are displaceably coupled relative to each other by a guiding groove.

9. The system according to claim 1, wherein the blocking element comprises at least one retaining member for retaining the stopper plate in the blocking position.

* * * * *